United States Patent [19]

Eriksson et al.

[11] 4,092,224

[45] May 30, 1978

[54] PROCESS OF ZINC COATING FASTENERS

[75] Inventors: Hans Edvin Åke Eriksson; Bengt Sune Kåberg; Nils Torsten Rehnovist, all of Hallstahammar, Sweden

[73] Assignee: Bulten Kanthal Aktiebolag, Sweden

[21] Appl. No.: 699,503

[22] Filed: Jun. 24, 1976

[30] Foreign Application Priority Data

Jun. 25, 1975 Sweden ..... 7507293

[51] Int. Cl.[2] ..... C25D 5/34; C25D 7/02

[52] U.S. Cl. ..... 204/32 R; 204/38 B

[58] Field of Search ..... 204/38 B, 32 R; 427/406

[56] References Cited

U.S. PATENT DOCUMENTS 1,984,335 12/1934 Crapo ..... 204/38 B

*Primary Examiner*—G. L. Kaplan
*Assistant Examiner*—William Leader
*Attorney, Agent, or Firm*—Hill, Gross, Simpson, Van Santen, Steadman, Chiara & Simpson

[57] ABSTRACT

A process of zinc coating fasteners such as screws and nuts, wherein the fastener is first provided with a zinc coat by hot coating, which coat is then equalized chemically, whereafter there is applied a superficial zinc coat by electrocoating. If desired, the fastener may then be chromated.

6 Claims, 6 Drawing Figures

Fig. 1
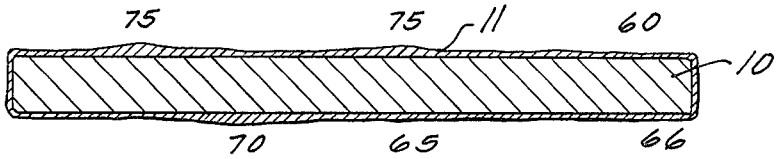
Fig. 2
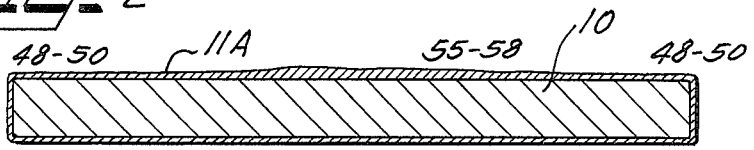
Fig. 3
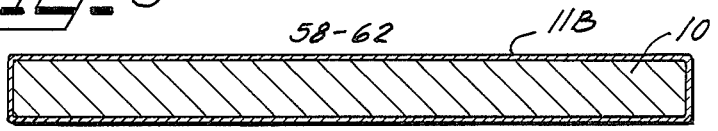
Fig. 4
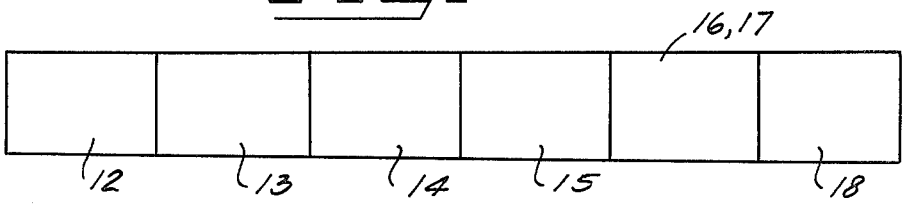
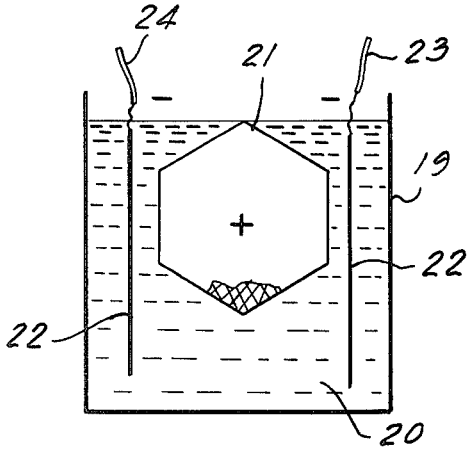
Fig. 5
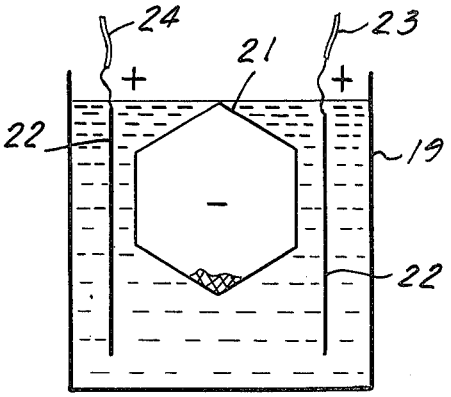
Fig. 6

PROCESS OF ZINC COATING FASTENERS

BACKGROUND OF THE INVENTION

1. Field of the Invention

This invention is directed to a process of zinc coating fasteners, such as screws and nuts.

2. Prior Art

One known process of zinc coating is the heat-coating process wherein the articles to be coated are dipped into a bath of molten zinc. This process produces a heavy zinc coat thickness, a rather even total zinc distribution, also on complicated articles, and a good resistance to corrosion. However, this process provides a bad surface finish and there is a risk of local zinc accumulations. Such local zinc accumulations may cause problems at the application of the fasteners and hot-coated fasteners can, for this reason, seldom be used in automatic applicators. Furthermore, the possibility to protect the hot-coated layers against self-corrosion (so called white-blisters) by chromating is limited.

Another known process of zinc coating is the electrocoating process. This process produces a good surface finish, and the application or assembling properties with smaller zinc coat thicknesses present are good; also, this process permits different kinds of chromating. However, with greater zinc coat thicknesses, the electrocoating process gives rise to an uneven zinc distribution due to a so called point-effect; further, the resistance to corrosion is comparatively low, and there exists a risk for hydrogen absorption.

SUMMARY OF THE INVENTION

In accordance with the present invention, there is provided a process of zinc coating fasteners, such as screws and nuts, wherein the fasteners are given a thick, even and corrosion resistant zinc-coat which provides good application properties.

The process of zinc coating fasteners comprises the steps of washing, pickling and fluxing the fasteners, if necessary, and then, in accordance with the present invention, applying a first zinc coat by heat-coating, equalizing such first zinc coat chemically, preferably electrochemically, and applying a superficial second zinc coat by electro-coating.

Though the zinc-coat according to the invention affords a good corrosion-resistance, it is preferable to chromate the fasteners, for instance by yellow chromating, namely on one hand to give a better resistance against "white blister" and on the other hand to provide a color marking of the fasteners. Other chromates than yellow chromating can, also be used, such as for instance green, black or bright chromating.

According to the invention it has been found especially suitable to carry out the equalization by a reversed electrolytical galvanizing process, whereby a zinc removal and smoothing out is obtained. The removed zinc is then precipitated on the "zinc anode". After changing the poles, the same zinc is precipitated on the fastener in the form of electrolytic zinc to a predetermined total coat thickness, whereby all the removed zinc is reclaimed. By this method the point effect at the electrocoating is compensated for by the "reversed" point effect which occurs at the equalization.

In accordance with the invention, the first coating step is preferably carried out in such a manner that the zinc layer applied by heat-coating has a thickness within the range of 50–80 μm. Then, the equalization is preferably carried on so far that the zinc coat has a thickness of about 45–55 μm, where it has its minimum thickness, and of about 50–60 μm where it has its maximum thickness. Finally, the electrocoating is carried on so that the combined zinc coat has an even thickness of about 55–65 μm, preferably about 58–62 μm.

Accordingly, it is an object of the invention to provide a process by which fasteners can be zinc coated in an efficient and reliable manner.

Another object of the invention is the elimination of the disadvantages discussed above.

Other advantages, features and additional objects of the present invention will become manifest to those versed in the art upon making reference to the detailed description and the accompanying sheet of drawings.

ON THE DRAWINGS

FIG. 1 is a diagram of a workpiece after the heatcoating;

FIG. 2 is a diagram of the workpiece in FIG. 1 after equalization;

FIG. 3 is a diagram of the workpiece in FIGS. 1 and 2 after the electrocoating;

FIG. 4 shows a flow chart for the different steps according to the invention; and FIGS. 5 and 6 show schematically an apparatus for carrying out two of the steps according to the invention.

AS SHOWN ON THE DRAWINGS

FIG. 1 is a diagram showing in cross-section an article in the shape of a threaded pin 10 provided with a zinc coat 11 by heatcoating. The threads are not shown. The FIGS. 75, 75, 60, 70, 65 and 66 denote the respective thicknesses in μm of the zinc coat at some places on the pin. The coating is shown in exaggerated thickness.

FIG. 2 shows the same pin 10 after the equalization step. The equalized zinc coat, denoted 11A, has now an average thickness of about 48–50 μm at the ends of the pin 10, and a thickness of about 55–58 μm at the middle portion of the threaded pin 10.

In FIG. 3 the same pin 10 is shown after the electrocoating step. The combined zinc coat 11B has now a thickness of about 58–62 μm along the full length of the pin 10.

FIG. 4 shows a flow chart for the different coating steps and illustrates that the process is normally started by washing the articles to be coated in a washing step 12, followed by a pickling step 13. The pickling is preferably carried out in a hydrochloric or sulfuric acid bath. If necessary sand blasting may be utilized. Then, the articles are fluxed in a fluxing step 14, comprising immersing the articles in a zinc ammonium chloride bath and drying the articles in hot air.

Then, following these preparatory steps, the articles are provided with a zinc coat in a hotcoating step 15, after which follows an equalization step 16 and an electrocoating step 17. The steps 16 and 17 are shown in one and the same box to indicate that they may advantageously be carried out in one and the same piece of equipment.

Step 18, indicates a final optional chromating step.

FIGS. 5 and 6 show schematically an apparatus for use in the equalization and electrocoating steps 16, 17. The apparatus comprises a tank 19 to hold a suitable quantity of electrolyte 20. In the tank 19 there is disposed a preferably rotatable barrel 21 with perforated walls. A plurality of electrode plates 22 of iron or zinc (only two shown) are immersed into the electrolyte and are each by means of suitable wires 23, 24 connected to a current source (not shown) through suitable control means. The barrel 21 is connected to the current source through suitable connecting wires (not shown). In operation electric current is passed through the electrodes 22, the electrolyte 20 and the barrel 21, having the articles to be coated therein, and more precisely with the barrel 21 and the articles therein coupled as an anode, FIG. 5, for the equalization step, and with the barrel 21 and the articles therein coupled as cathodes, FIG. 6, for the electrocoating step.

EXAMPLE I

A quantity of ordinary screws having hexagonal heads was washed, pickled in hydrochloric acid, fluxed in zinc ammonium chloride and dried as usual in connection with zinc heat coating.

This screw quantity in a basket was then immersed in a zinc bath having a temperature of about 550° C for slightly more than one minute. As the screws were taken up from the zinc bath they were centrifuged for about 5 seconds in the same basket to throw off superfluous zinc. The peripheral speed of the basket during centrifugation was about 800 m/min.

The screws were then transferred into an equalization and electrocoating apparatus of our own construction wherein they were first subjected to an equalization step with the screws coupled as an anode. The current density was 1.8–1.9 amperes per square decimeter electrode surface. The electrolyte comprised 12 g/l Zn, 20 g/l NaCN and 85 g/l NaOH. The electrolyte temperature was maintained at about 26° C. The equalization was carried on for about 15 minutes during which time about 10 μm zinc was removed from the heat coat zinc layer, which was originally about 60–70 μm thick. Also, at this equalization step, all greater zinc protrusions were removed.

After the equalization step, the current was switched off for about 5 min., during which the superficial zinc sludge film on the screws was dissolved.

Finally, the screws were provided with a superficial zinc electrocoating in the apparatus used for the equalization step but with the current direction reversed. The thickness of this superficial layer was about 10 μm, which was obtained by maintaining this current flow direction for a period of about 40 min. at a current density of slightly above 1 A/dm$^2$.

Following this deposition of the superficial zinc coating the screws were flushed in water and chromated yellow in a conventional way, again flushed in water and dried in hot air.

EXAMPLE II

Example II is the same as Example I with the exception that the heatcoat layer, before the equalization, was only about 30 μm, of which about 5–10 μm was removed during the equalization, carried out at a current density of 1,8 A/dm$^2$ during about 10 min.

The Table below shows comparison corrosion tests in salt mist according to ASTm B 117-64 (5 ± 1% NaCl, 35 ± 2° C, pH 6.5–7.2) comprising screws galvanized according to the invention, samples I–IV; warm-coated screws, samples V, VI; and electrocoated screws, samples VII–X.

| Sample No. | Zinc-coat thickness | Hours until the beginning of zinc-corrosion (white blister) | Hours until the beginning of basic material corrosion (red rust) |
|---|---|---|---|
| (I) Bufo-zinc bright-chromated | 60 μm | 16 | 800 |
| (II) Bufo-zinc yellow-chromated | 60 μm | 72 | 900 |
| (III) Bufo-zinc green-chromated | 60 μm | 96 | 1000 |
| (IV) Bufo-zinc black-chromated | 60 μm | 20 | 800 |
| (V) Warmcoating no chromating | 60 μm | 0 | 750 |
| (VI) Warmcoating chromated | 60 μm | 16 | 800 |
| (VII) Electrocoating bright-chromated | 10 μm | 16 | 72 |
| (VIII) Electrocoating yellow-coating | 10 μm | 72 | 120 |
| (IX) Electrocoating green-chromated | 10 μm | 96 | 144 |
| (X) Electrocoating black-chromated | 10 μm | 20 | 72 |

We claim as our invention:

1. A process of zinc coating fasteners comprising the steps of:

(a) applying a first zinc coat to the fasteners by heat coating;

(b) equalizing said first zinc coat electrochemically; and (c) applying a second, superficial zinc coat to said first zinc coat by electro-coating.

2. A process according to claim 1, said equalization being carried out in an electrolyte with a current which is reversed in direction from the direction of current used for the electro-coating.

3. A process according to claim 2, said equalization of the first zinc coat and said electro-coating being carried out in one and the same electrolyte.

4. A process according to claim 3, including the step of chromating the fasteners after the electro-coating.

5. A process according to claim 1, said fasteners being provided with a heat-coat thickness of the magnitude of 50 to 80 μm, said equalization being carried on until the coat has a thickness of the magnitude of 45 to 55 μm at the thinnest places and about 50 to 60 μm at the thickest places, and said electro-coating finally being carried on until the combined final coat has an even thickness of the magnitude of 50 to 65 μm.

6. A process according to claim 5, said electroplating being carried on until the combined final coat's thickness is between 58 and 62 μm.

* * * * *